United States Patent [19]

Fukazawa

[11] 4,154,232

[45] May 15, 1979

[54] MASSAGER

[76] Inventor: Syouji Fukazawa, 25-2, Nishimachi, Fujinomiya-shi, Shizuoka-ken, Japan

[21] Appl. No.: 833,038

[22] Filed: Sep. 14, 1977

[51] Int. Cl.[2] ..... A61H 7/00; A61H 15/00

[52] U.S. Cl. ..... 128/52; 128/57; 128/58

[58] Field of Search ..... 128/52, 57, 58, 44, 128/33, 24.1, 24.2, 24.3, 56

[56] References Cited

U.S. PATENT DOCUMENTS

| | | | |
|---|---|---|---|
| 2,230,057 | 1/1941 | Hill | 128/57 |
| 3,003,497 | 10/1961 | Nunes | 128/57 |
| 3,464,406 | 9/1969 | Kunce | 128/57 |

*Primary Examiner*—Lawrence W. Trapp
*Attorney, Agent, or Firm*—Kurt Kelman

[57] ABSTRACT

A massager which comprises a moving bed disposed above a frame so as to be movable in the longitudinal direction of said frame, a plurality of massaging rolls disposed underneath said moving bed and rotary-reciprocal motion conversion means adapted to drive said moving bed and said massaging rolls by the media of drawing means and rotating means. A motion imparted to the rotary-reciprocal motion conversion means causes said moving bed to produce a reciprocating motion and said massaging rolls to produce a rotating motion, with the result that a massaging effect is brought out on the body of a patient lying on the moving bed.

6 Claims, 6 Drawing Figures

MASSAGER

BACKGROUND OF THE INVENTION

This invention relates to a massager. More particularly, the present invention relates to a massager which is provided with a moving bed disposed above a frame and adapted to produce a reciprocating motion in the longitudinal direction of said frame and a plurality of massaging rolls adapted to rotate while keeping sliding contact with the lower side of said moving bed, whereby said massaging rolls and said moving bed are put to operation by one common driving motor.

As a massager of this class, there has heretofore existed a rolling type massager wherein the reciprocating motion of a moving bed and the rotating motion of massaging rolls are produced by a plurality of independent motors. In this massager, the reciprocating motion of the moving bed has been produced by a device which has limit switches disposed one each at the forward and backward extremities of said moving bed so that the motion of the moving bed in one direction is reversed at the moment that the bed reaches and hits the limit switch located at the end of the bed's travel in that direction and the limit switch thus actuated causes the motor to start rotating in the reverse direction.

The conventional device which resorts to such an operating principle has necessitated incorporation of a plurality of motors in conjunction with switches designed to give required control to said motors. Thus, the device inevitably has entailed a disadvantage that the structure is complicated, the cost of manufacture is high, and so on.

An object of the present invention is to provide a massager of a simplified structure such that the reciprocating motion of the moving bed and the rotating motion of the massaging rolls are produced by one common motor of which the rotation need not be reversed but can be maintained in one direction.

SUMMARY OF THE INVENTION

To attain the object described above according to the present invention, there is provided a massager which comprises a moving bed disposed above a frame in such a manner as to be movable in the longitudinal direction of said frame, a plurality of massaging rolls disposed in the direction of the width of said moving bed, arranged parallelly at suitably spaced positions on said frame under the path of the motion of the moving bed and held in sliding contact with the lower side of the moving bed so as to impart massaging motions into the body of a patient laid on the moving bed and rotary-reciprocal motion conversion means adapted to be driven alternately in two opposite directions by the rotation in one fixed direction of a motor and interposed between the motor and means for imparting an alternating drawing motion to the moving bed and means for imparting a rotating motion to the rolls.

Said rotary-reciprocal motion conversion means serves the purpose of converting the rotating motion of the one common motor into a linear motion and causing the moving bed to produce an alternating motion through the medium of drawing means and the massaging rolls to produce a rotating motion through the medium of rotating means. Thus, the present invention provides a massager which is simple in structure and easy of operation.

The other objects and characteristic features of the present invention will become apparent from the detailed description to be given hereinafter with reference to the accompanying drawings.

DESCRIPTION OF THE PREFERRED EMBODIMENTS

Figure 1:
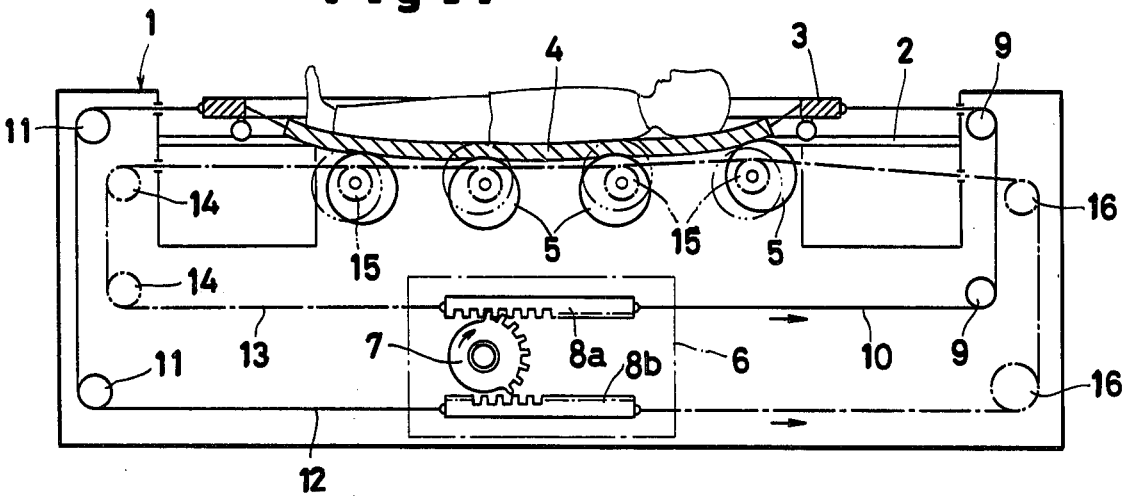
FIG. 1 is an explanatory diagram in side elevation illustrating the operating principle of one preferred embodiment of the massager of the present invention.
Figure 2:
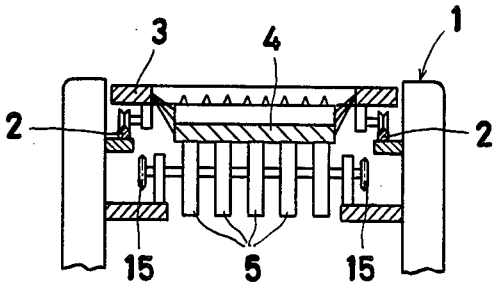
FIG. 2 is a partially sectioned front view of the massager of FIG. 1.

With reference to the drawings, two rails 2 are laid on the upper surface of a frame 1 in the longitudinal direction of the frame, wheels rotatably attached to the lateral outer sides of a moving bed 3 are mounted on said rails, so that said moving bed is movable on the rails 2 in the longitudinal direction thereof. Inside the frame of the moving bed, a mat 4 is stretched in the same way as a hammock so as to permit a patient to lie down on his back thereon.

Beneath the mat 4 of the moving bed 3, a plurality of shafts each pierced eccentrically through a plurality of massaging rolls 5 are arranged parallelly with one another, so that the body weight of the patient is supported on these massaging rolls.

Inside the frame 1 is further disposed rotary-reciprocal motion conversion means 6 formed of a motor, a speed reducer, a sector gear 7 adapted to be driven thereby and racks 8*a*, 8*b* opposed each other across said sector gear 7 and interlocked with each other through the medium of the sector gear 7, whereby a rotating motion is converted into a linear motion. The sector gear 7 has its teeth formed on substantially one half of the entire rim thereof. Because of this construction, when the sector gear 7 is rotated clockwise, the first half rotation of the gear causes the rack 8*a* to be moved to the right and the remaining half rotation thereof causes the rack 8*b* to be moved to the left. It is naturally necessary that the racks 8*a*, 8*b* should be provided with proper means adapted to guide them along a fixed path.

The righthand extremity of one rack 8*a* is connected to the righthand extremity of the frame portion of the moving bed through the medium of drawing means 10 such as of a wire passed around a pulley 9 and the lefthand extremity of the other rack 8*b* is connected to the lefthand extremity of the frame portion of the moving bed through the medium of drawing means 12 similarly passed around a pulley 11. To the lefthand extremity of the rack 8*a* is connected rotating means 13 such as of a chain, which is passed around sprockets 14, extended along the path of the motion of the moving bed, fastened sequentially to the sprockets 15 attached to the shafts of massaging rolls, passed around sprockets 16 and tied at its end to the righthand extremity of the other rack 8*b*.

After a patient has been laid on his back on the mat of the moving bed and the motor has been started, the sector gear 7 is rotated clockwise at a low speed. Consequently the one rack 8a which is meshed with the teeth of the sector gear 7 is pushed out to the right. This motion of the rack 8a draws the rolls' rotating means 13 and causes the massaging rollers 5 to be rotated counterclockwise by the medium of the individual sprockets 15 of massaging rollers connected to said rotating means 13. Besides, the rack 8b connected to the rotating means 13 is advanced to the right, with the result that the moving bed 3 is drawn to the left by the drawing means 12.

The patient's body lying on the mat of the moving bed, therefore, is moved to the left in conjunction with the moving bed and is simultaneously massaged by the motions imparted thereto through the mat 4 by the massaging rolls 5 which keep tight sliding contact with the lower side of the mat. As the last of the teeth of the sector gear 7 separates from engagement with the rack 8a, the first of the teeth comes into engagement with the rack 8b. During the subsequent half rotation of the gear, the rack 8b is caused to move to the left. Consequently, the moving bed is drawn by the drawing means 18 to the right, namely in the direction opposite the direction in which is drawn by the motion of the rack 8a. In this case, the patient's body is massaged while the massaging rolls 5 are rotated clockwise. As the sector gear 7 is rotated in one fixed direction, the two halved rotations thereof cause the moving bed 3 to be moved alternately to the left and right. The direction in which the massaging rolls are rotated in the interface between the patient's body and the rolls can be made to conform with the direction of the motion of the moving bed by allowing the rotating means 13 to be brought into engagement with the sprockets 15 downwardly as illustrated, making it possible to produce a proper intensity of massaging.

Figure 3:
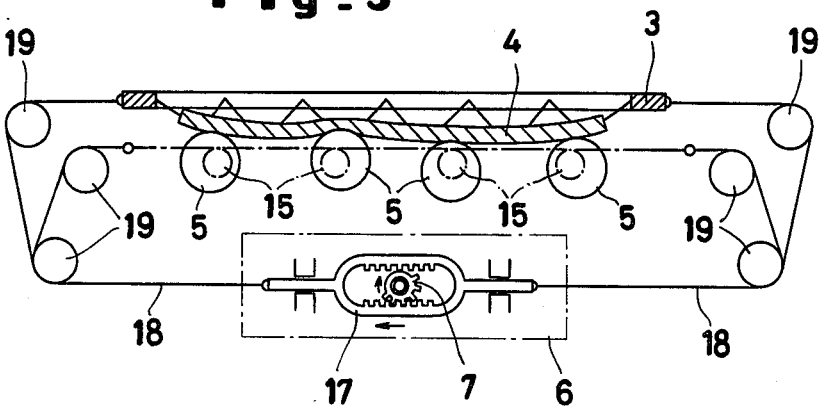
FIGS. 3 and 4 are explanatory diagrams in side elevation illustrating second and third preferred embodiments of the massager of the present invention.

FIG. 3 is a second preferred embodiment of the present invention. If this preferred embodiment, the rotary-reciprocal motion conversion means 6 has a structure such that the racks opposed each other in the vertical direction across the sector gear 7 are formed on the inside of an integral sliding frame 17. This structure dispenses with the rotating means such as of a chain which is extended out of the rotary-reciprocal motion conversion means and only requires two drawing means 18 to be extended one each from the lefthand and righthand extremities thereof. These drawing means are branched off en route, the one branch to be connected to the moving bed 3 and the other branch to be joined en route into the rotating means such as of a chain which is fastened to the sprockets 15 of the massaging rolls 5.

Although the second preferred embodiment brings about the same effect as the preferred embodiment of FIG. 1, it is simplified with respect to the construction of the drawing means for the moving bed and the rotating means for the massaging rollers in the massager.

Figure 4:
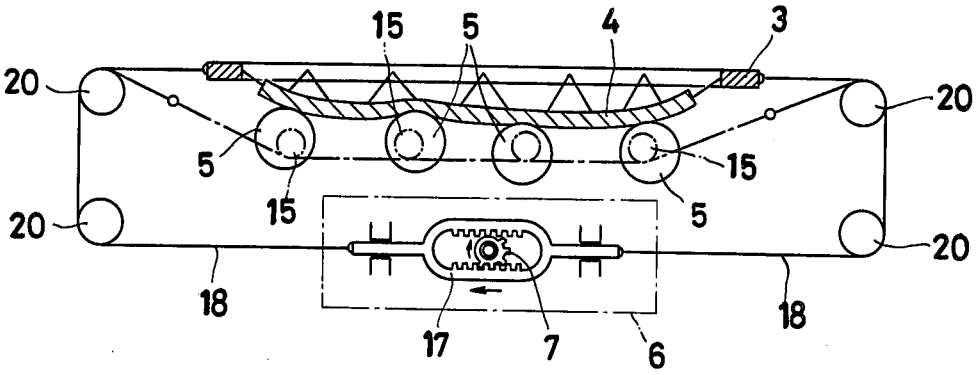

FIG. 4 represents a third preferred embodiment which is a further simplified version of the massager of FIG. 3. This preferred embodiment is characterized not merely by the simplified construction but also by the fact that in contrast to the foregoing preferred embodiments in which the direction of the motion of moving bed is in conformity with the direction of the sliding motion produced between the massaging rolls and the lower side of the mat of the moving bed, this preferred embodiment produces the sliding motion in the direction opposite that of the motion of the moving bed. This opposition between the two directions is accomplished by causing the drawing means 18 led out of the rotary-reciprocal motion conversion means 6 to be passed around sprockets 20 and subsequently to be branched off, with the one branch connected to the moving bed 3 and the other branch fastened upwardly to the sprockets 15 of the massaging roll 5. This preferred embodiment can intensify the pressure which is exerted on the patient's body.

Figure 5:
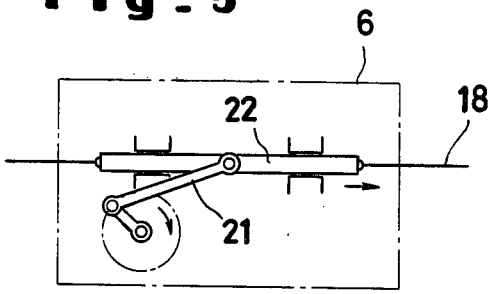
FIGS. 5 and 6 are explanatory diagrams illustrating other preferred embodiments of the rotary-reciprocal motion conversion means for use in the massager of the present invention.
Figure 6:
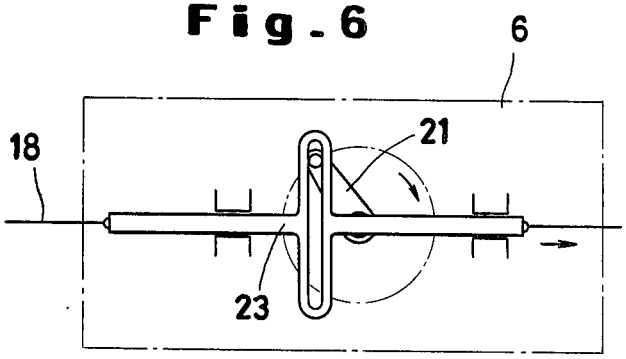

FIGS. 5 and 6 represent other preferred embodiments of the rotary-reciprocal motion conversion means 6. FIG. 4 illustrates a construction wherein the rotation such as of a motor is converted into a reciprocating linear motion by causing the rotation to be transmitted to a sliding member 2 through the medium of a crank 21. FIG. 5 illustrates a construction wherein a cross slider 23 is used with a crank 21 so that a desired alternating motion can be produced efficiently by use of one motor. For their effective operation, these means have only to be connected to the drawing means 18 as illustrated.

Desirably, the peripheries of the massaging rolls may be formed in the shape of hand drums, cone pulleys, or grooved wheels so that the cervical and other vertebrae fall into the grooves and similar recesses formed in the peripheries.

As described above, the present invention permits the reciprocating motion of the moving bed and the rotating motion of the massaging rolls productive of a massaging effect to be obtained by the rotation of a common motor in one fixed direction. With a simple construction, this invention can eliminate the disadvantages suffered by the conventional massagers. Further, use of massaging rolls which are formed of eccentric rolls having their shafts eccentrically pierced therethrough permits the affected region of a patient's body to be kneaded with a series of alternatingly strengthened and weakened grips. The massaging effect brought about by use of such eccentric massaging rolls is strong as compared with that obtainable by use of concentric massaging rolls having their shafts concentrically pierced therethrough.

The motions to be exerted upon the patient's body may desirably by softened by covering the peripheries of massaging rolls with a synthetic rubber or sponge or by making the mat 4 with a carefully selected material such as blanket or sponge sheet.

What is claimed is:

1. A massager comprising in combination a frame; a moving bed disposed above said frame in such a manner as to be movable in the longitudinal direction of said frame; a plurality of massaging rolls mounted at prescribed intervals on said frame and held in sliding contact with the lower side of said moving bed; drawing means serving to impart a reciprocating motion to said moving bed; rotating means serving to impart a rotating motion to said plurality of massaging rolls; and rotary-reciprocal motion conversion means serving the purpose of causing the rotating motion of a motor for operating said drawing means and said rotating means to be converted into a reciprocating linear motion.

2. The massager according to claim 1, wherein said rotary-reciprocal motion conversion means comprises a rotary sector gear and racks opposed each other in the vertical direction across said sector gear.

3. The massager according to claim 1, wherein said rotary-reciprocal motion conversion means comprises a crank and a sliding member.

4. The massager according to claim 1, wherein said rotary-reciprocal motion conversion means comprises a crank and a cross slider.

5. The massager according to claim 1, wherein said massaging rolls have their peripheral shapes eccentrical relative to the axes of rotation around which the rolls are rotated by said rotating means.

6. The massager according to claim 1, wherein the direction of the motion of said moving bed and the motion of the sliding contact between said massaging rolls and the moving bed are opposite.

* * * * *